US006765311B1

(12) United States Patent
Labonde

(10) Patent No.: US 6,765,311 B1
(45) Date of Patent: Jul. 20, 2004

(54) MOTOR-VEHICLE KEY FOR REMOTE-CONTROLLED MOTOR-VEHICLE LOCKING SYSTEM

(75) Inventor: Damien Labonde, Essen (DE)

(73) Assignee: Kiekert AG, Heiligenhaus (DE)

( * ) Notice: Subject to any disclaimer, the term of this patent is extended or adjusted under 35 U.S.C. 154(b) by 279 days.

(21) Appl. No.: 10/070,943

(22) PCT Filed: Sep. 2, 2000

(86) PCT No.: PCT/EP00/08578

§ 371 (c)(1),
(2), (4) Date: May 1, 2002

(87) PCT Pub. No.: WO01/20110

PCT Pub. Date: Mar. 22, 2001

(30) Foreign Application Priority Data

Sep. 10, 1999 (DE) ..... 199 43 498

(51) Int. Cl.[7] ..... E05B 19/00
(52) U.S. Cl. ..... 307/10.1; 70/456 R; 70/400
(58) Field of Search ..... 307/10.1; 70/456 R, 70/400

(56) References Cited

U.S. PATENT DOCUMENTS

| | | | | | |
|---|---|---|---|---|---|
| 4,524,594 | A | * | 6/1985 | Bascou | 70/456 R |
| 4,941,569 | A | * | 7/1990 | Lindmayer et al. | 206/38.1 |
| 4,998,952 | A | * | 3/1991 | Hyatt et al. | 70/395 |
| 5,561,331 | A | | 10/1996 | Suyama et al. | |
| 6,050,118 | A | * | 4/2000 | Kito | 70/456 R |
| 6,216,501 | B1 | * | 4/2001 | Marquardt et al. | 70/252 |
| 6,275,141 | B1 | * | 8/2001 | Walter | 307/10.4 |
| 6,386,007 | B1 | * | 5/2002 | Johnson et al. | 70/408 |
| 6,437,684 | B1 | * | 8/2002 | Simeray | 340/5.67 |
| 6,442,985 | B1 | * | 9/2002 | Watanuki et al. | 70/186 |
| 6,460,386 | B1 | * | 10/2002 | Watanuki et al. | 70/456 R |
| 6,546,768 | B1 | * | 4/2003 | Burghoff et al. | 70/252 |
| 6,553,802 | B1 | * | 4/2003 | Jacob | 70/456 R |
| 6,647,752 | B1 | * | 11/2003 | Chaillie | 70/456 R |
| 6,705,141 | B1 | * | 3/2004 | Jacob et al. | 70/408 |
| 2003/0000267 | A1 | * | 1/2003 | Jacob et al. | 70/399 |

FOREIGN PATENT DOCUMENTS

| | | | | |
|---|---|---|---|---|
| DE | 39 02 537 | | 8/1990 | |
| DE | 44 44 913 | | 6/1995 | |
| DE | 287 22 484 | | 4/1998 | |
| DE | 299 02 629 | | 6/1999 | |
| EP | 0 987 389 | | 3/2000 | |
| EP | 1280390 | * | 5/2003 | H05K/1/14 |
| JP | 2000320202 | * | 11/2000 | E05B/19/00 |
| JP | 2001146862 | * | 5/2001 | E05B/19/00 |
| WO | WO200036252 | * | 6/2000 | E05B/49/00 |

* cited by examiner

*Primary Examiner*—Brian Sircus
*Assistant Examiner*—Roberto J Rios
(74) *Attorney, Agent, or Firm*—Herbert Dubno; Andrew Wilford

(57) ABSTRACT

The invention relates to a motor-vehicle key, comprising a key housing (2, 3), in which an emergency key (5) is stored. The key housing (2, 3) has a cover shell (2) and a divided base shell (3) which is configured as two base-shell sections (3*a*, 3*b*). The emergency key (5) is fixed to one of the base-shell sections (3*a*) by its key head (7), whilst the other base-shell section (3*b*) has a shaft recess (8) for the key shaft (9).

7 Claims, 2 Drawing Sheets

Fig.1
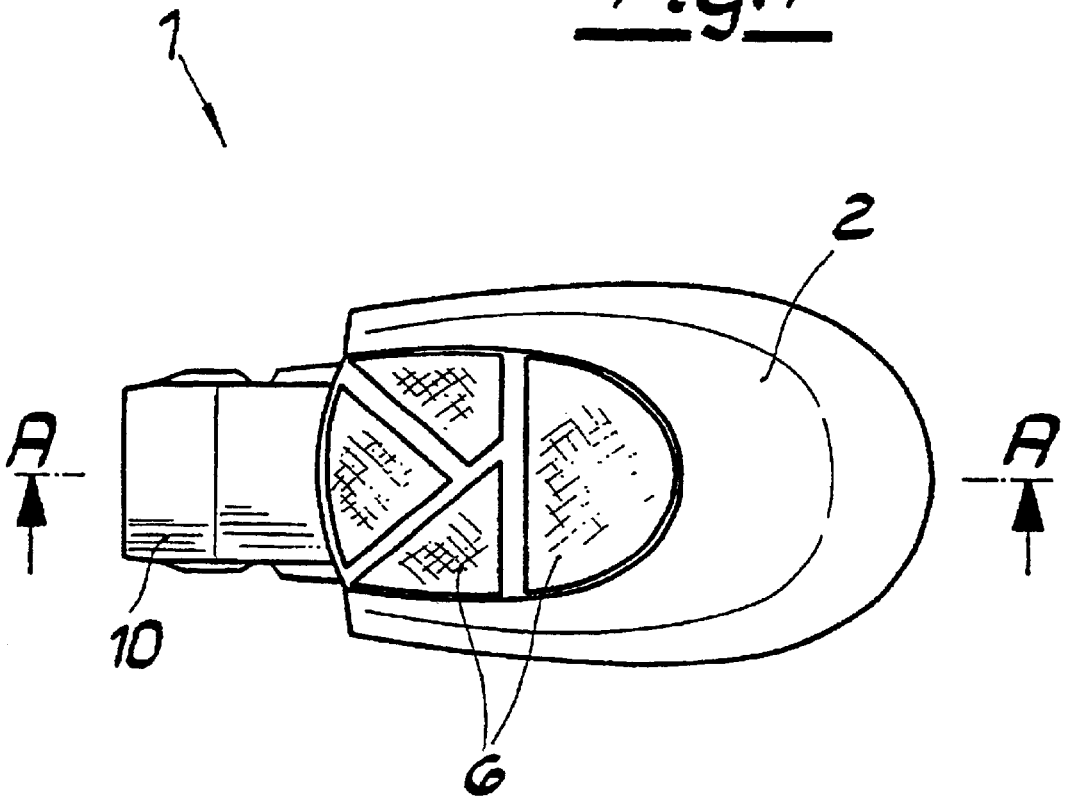
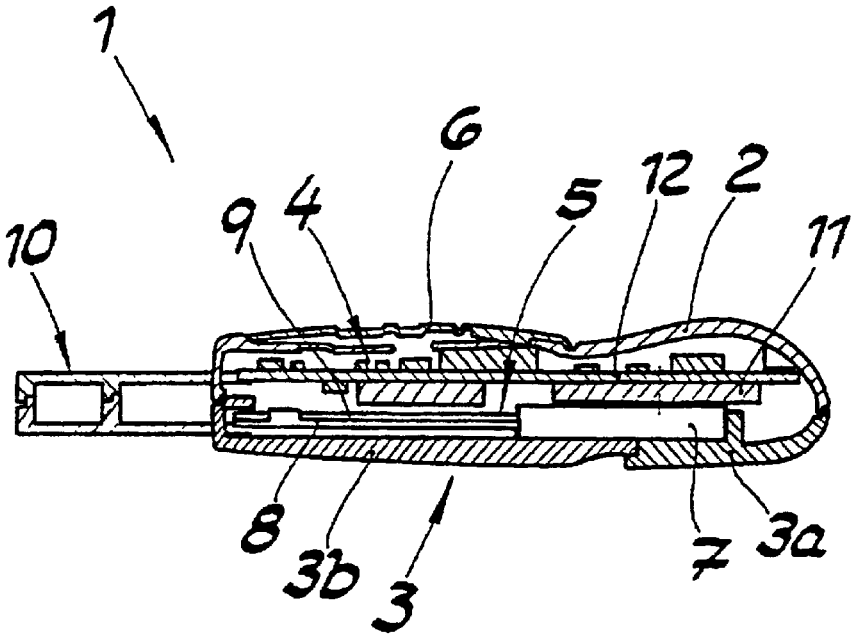
Fig.2

MOTOR-VEHICLE KEY FOR REMOTE-CONTROLLED MOTOR-VEHICLE LOCKING SYSTEM

DESCRIPTION

The invention relates to a motor-vehicle key for a remote-controlled motor-vehicle locking system. Such a motor-vehicle key is also called an electronic key. A remote-controlled locking system can be a locking system equipped with a mechanically actuatable remote controller as well as a locking system provided with a coil in a so-called "check card" or transponder, for example where the locking action is set in operation by actuation of a door handle.

Since the introduction of remotely operable motor-vehicle locking systems the use of the standard mechanical key has been limited as a rule to the occasional circumstances when the remote-control system, for example, does not work because of insufficient power or other reasons. Only under these conditions must one use a mechanical key that actually serves as an emergency key and generally is constructed of materials, e.g. plastic, that are not suitable for the long service life of a standard motor-vehicle key. In addition it has been noted that after years of using a mechanically actuated locking system the user has a tendency to want to do the unlocking by means of a key held in the hand.

In particular a key holder with a owing-out emergency key is known. the emergency key is held in a side pocket of the key holder and is thus relatively easy to access and even see from outside (see German 3,902,537).

Furthermore an electronic remote-control key is known where the key housing has the external shape of a car and the emergency key has a blade inserted into the front or rear of the car-shaped housing. In this case the emergency key in the key housing forms a push rod. The push rod in turn forms the key head or the key grip and projects from the car-shaped housing in order to be directly accessible in case of need and so that it can be pulled out (see German 297 22 484). As a result it is not out of the question that the user out of habit pulls out the thus mounted emergency key to open the car. In addition the projecting key can be a hindrance.

Finally an electronic key is known for use with locking systems in motor vehicles that has a housing on which an additional key blade is provided as emergency key for a mechanical lock. The emergency key is formed as a separate key from the key. The housing has a socket in which the blade of the emergency key fits. With this known embodiment the housing has a grip part for the user and a jack part formed on it while the emergency key has like a standard key a blade and a grip part which projects from the housing. Finally the emergency key does not fit fully into the actual key housing. This is unsatisfactory (see German 4,444,913).

OBJECT OF THE INVENTION

It is an object of the invention to provide a motor-vehicle key for remote-control motor-vehicle locking systems where the emergency key is readily accessible in case of emergency but where it is used just out of habit is impeded. In addition the emergency key intended only for emergency use is to be protected against damage.

SUMMARY OF THE INVENTION

In order to attain this object the invention is a motor-vehicle key for a remote-control motor-vehicle latching system having a key housing holding a remote-control circuit and a mechanical emergency key and wherein the key housing has a cover with a keypad and a split base formed by two base parts the emergency key has a key head connected with the base the part forming a key grip, and the other base part has a seat for the key blade The features of the invention have the effect that the emergency key is wholly contained in the key housing and thus is integrated in the key housing formed as a transmitter housing. In this manner the emergency key is not visible or noticeable from outside so that the vehicle or key user is not going to be inclined to use the emergency key to open the vehicle and in fact such usage is made difficult. Thus the emergency key, if it is for example made of plastic, is not damaged by unnecessary use. In fact the key housing gives no clue to the presence of an emergency key inside the housing which has a standard external design. Mounting the emergency key in the key housing allows the housing to be made as small as possible in that the base part also forms the key head while the other base part forms a seat for the key blade.

Further features are describe in the following. Thus the key blade is releasably retained in the base part. According to a further embodiment of the invention it is also possible for the key blade to be longitudinally slidable in the key-grip forming base part and when fully inserted is operational and releasably retained in the base part. Such a slide interfit of the emergency key allows a further reduction of the length of the key housing and minimizing of its outside dimensions. The invention further proposes that the base be transversely split and the two base parts be snap-fitted together. Preferably the cover and the base are connected together by ultrasonic welding or adhesive bonding. Thus the base part forming the key grip, when the battery needs to be changed, can simply be pulled out of the base part 3 holding the key blade. In addition the cover and the base have an ignition-key stump for starting the car so that when the stump of the key is turned in the ignition the transponder in the housing is read (travel lock). Finally according to the invention the emergency key is mounted underneath the remote-control circuit in the base and the key head presses a battery into electrical contact against a circuit plate of the remote-control circuit when the emergency key is fitted into the key housing. The remote-control circuit has on the circuit plate the standard transmitter and receiver and a controller and integrated transponder for a drive lock, or alternatively is provided with a coil or a transponder for the locking system.

BRIEF DESCRIPTION OF THE DRAWING

In the following, the invention will be more closely described with reference to a drawing showing a single embodiment. Therein:

FIG. 1 is a motor-vehicle key according to the invention in a schematic view;

FIG. 2 is a section along line A—A of FIG. 1; and

SPECIFIC DESCRIPTION

Figure 3:
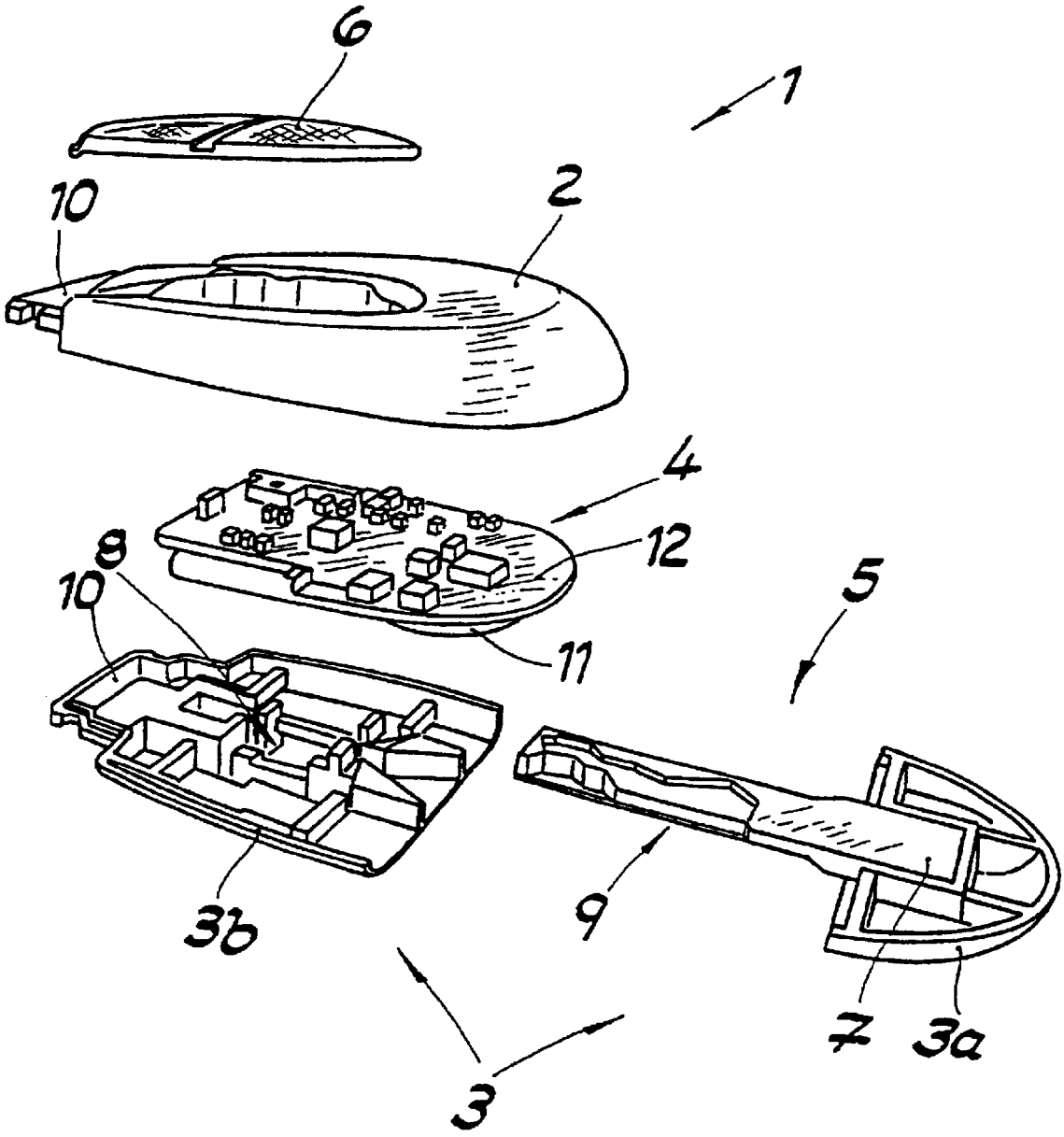
FIG. 3 is an exploded view of the structure of FIG. 1.

The Figures show a motor-vehicle key for a remote-control motor-vehicle locking system. This motor-vehicle key 1 has a key or transmitter housing 2, 3 in which a schematically illustrated remote-control circuit 4 and a mechanical emergency key 5 are held. The key housing has a cover 2 with a keypad 6 and a split base 3 formed by two base parts 3*a* and 3*b*. The emergency key 5 has a key end 7 seated in the base part 3*a* forming a key head while the other base part 3*b* has a seat 8 for a blade 9 of the key. The key blade 9 is retained in the base part 3*b* releasably by a catch. The base 3 is subdivided transversely. The two base parts 3*a* and 3*b* thus formed are snapped together according to this embodiment so the emergency key 5 can be taken out. The cover part 2 and the base holding the key blade 9 are bonded together by ultrasonic welding or an adhesive. The cover 2 and the base 3 and thus the key housing have also an ignition key stump 10.

The emergency key 5 is mounted underneath the remote-control circuitry 4 in the base 3. The key head 7 holds a battery 11 in contact against an circuit plate 12 of the remote-control circuit 4.

The key housing and thus the cover 2 and base 3 are made according to this embodiment of plastic as is the emergency key 5 whose blade 9 can however be made of metal.

What is claimed is:

1. In combination:

a housing comprised of a cover, a first base part fixed to the cover, and a second bass part separable from the first base part and cover, the housing forming an ignition-key stump adapted to fit in an ignition of a motor vehicle;

a keypad on the cover;

remote-control circuitry inside the housing connected to the keypad and capable of operating a motor-vehicle locking system and a motor-vehicle ignition system;

an emergency key having a bitted blade fixed to the second base part, the first base part being formed with a seat in which the blade can fit with the second base part fitted closely against the cover, the second base part fitting snugly with the cover and first bass part, and the blade wholly contained in the housing.

2. The combination defined in claim 1 wherein the housing is provided with means for releasably retaining the blade in the seat.

3. The combination defined in claim 1 wherein the seat is open longitudinally and the blade is longitudinally slidable into the seat.

4. The combination defined in claim 3 wherein the base parts meet at a joint extending transversely of the blade.

5. The combination defined in claim 1, further comprising means permanently bonding the cover to the first base part.

6. The combination defined in claim 1 wherein the cover forms a battery holder, the combination further comprising:

a battery engaged between the key blade and the seat and held in the battery holder by the key blade.

7. The combination defined in claim 6 wherein only when the key blade is pulled out of the seat and the second base part is separated from the housing are the battery and the battery holder exposed.

* * * * *